US006260755B1

(12) United States Patent
Bates et al.

(10) Patent No.: US 6,260,755 B1
(45) Date of Patent: Jul. 17, 2001

(54) CARTON WITH REINFORCED HANDLE STRUCTURE

(75) Inventors: Aaron Bates, Marietta; James R. Oliff, Douglasville; John M. Holley, Jr., Lawrenceville, all of GA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/568,231

(22) Filed: May 5, 2000

Related U.S. Application Data

(63) Continuation-in-part of application No. 09/336,502, filed on Jun. 18, 1999, now Pat. No. 6,129,266.

(51) Int. Cl.[7] ..... B65D 5/468
(52) U.S. Cl. ..... 229/117.13; 229/117.12
(58) Field of Search ..... 229/117.12, 117.13; 206/141, 427

(56) References Cited

U.S. PATENT DOCUMENTS

| | | | | |
|---|---|---|---|---|
| 2,482,399 | | 9/1949 | Bullock | 229/117.13 |
| 2,896,838 | | 7/1959 | Struble | 229/117.12 |
| 3,094,268 | | 6/1963 | Swanson et al. | 229/117.13 |
| 3,300,119 | | 1/1967 | Chaussadas | 206/434 |
| 3,371,846 | * | 3/1968 | Detzel | 229/117.13 |
| 3,933,303 | | 1/1976 | Kirby, Jr. | 229/117.13 |
| 5,333,734 | | 8/1994 | Stout et al. | 206/427 |
| 5,385,234 | | 1/1995 | Stout et al. | 206/427 |
| 5,480,091 | | 1/1996 | Stout | 229/117.14 |
| 5,593,027 | | 1/1997 | Sutherland | 206/170 |
| 5,826,782 | | 10/1998 | Stout | 229/117.13 |
| 5,873,515 | | 2/1999 | Dunn et al. | 229/117.13 |
| 6,129,266 | * | 10/2000 | Oliff et al. | 229/117.13 |
| 6,131,803 | * | 10/2000 | Oliff et al. | 229/117.13 |

FOREIGN PATENT DOCUMENTS

| | | | | |
|---|---|---|---|---|
| 1489093 | * | 6/1967 | (FR) | 206/141 |
| 2274509 | * | 1/1976 | (FR) | 229/117.13 |
| 2 252 958 | | 8/1992 | (GB) . | |

* cited by examiner

*Primary Examiner*—Gary E. Elkins
(74) *Attorney, Agent, or Firm*—Michael V. Drew

(57) ABSTRACT

A handle structure for a carton is formed within a panel having a opposing side edges and opposing end edges that intersect to form corners of the handle panel, the handle structure. A strap member is integrally conjoined with the handle panel and extends between the end edges. Opposing strap edges are substantially disjoined from the handle panel. The strap member includes a substantially centrally disposed region wherein opposing central strap edge segments of the opposing strap edges are substantially parallel to and mediate the opposing side edges. A severance line segment is disposed proximate each of the corners of the handle panel extending from a first end point proximate an associated one of the corners to a second end point proximate the centrally disposed region of the strap member such that when a force that is substantially normal to a plane in which the handle panels lies is exerted upon the centrally disposed region, the strap member is flexed substantially outwardly of the plane from a biased position proximate the plane.

19 Claims, 5 Drawing Sheets

CARTON WITH REINFORCED HANDLE STRUCTURE

RELATED APPLICATIONS

This application is a continuation-in-part of application Ser. No. 09/336,502 filed Jun. 18, 1999, now U.S. Pat. No. 6,129,266.

TECHNICAL FIELD OF THE INVENTION

The invention relates to cartons, and more particularly, to cartons having a reinforced handle structure that enhances carton integrity and appearance.

BACKGROUND OF THE INVENTION

Handles are useful in cartons as a means for transporting the cartons. A problem in cartons of flexible material wherein a handle is formed in a panel of the carton is that the substantial stress forces are typically concentrated upon the handle or undesirable portions of the panel in which the handle resides. It can be appreciated that it ould be desirable to have a handle structure for a carton of flexible material that does not impart significant forces upon undesirable portions of the handle or the panel in which the handle resides.

It is often desirable to have a carton that presents walls that are as aesthetically appealing as possible to potential purchasers of the package formed by the carton. Thus, it can be appreciated that it would be desirable to have a carton with a handle structure that functions within a carton wall or panel that is also aesthetically appealing.

SUMMARY OF THE INVENTION

According to a preferred embodiment of the invention, a handle structure for a carton is formed within a panel having a opposing side edges and opposing end edges that intersect to form corners of the handle panel, the handle structure. A strap member is integrally conjoined with the handle panel and extends between the end edges. Opposing strap edges are substantially disjoined from the handle panel. The strap member includes a substantially centrally disposed region wherein opposing central strap edge segments of the opposing strap edges are substantially parallel to and mediate the opposing side edges. A severance line segment is disposed proximate each of the corners of the handle panel extending from a first end point proximate an associated one of the corners to a second end point proximate the centrally disposed region of the strap member such that when a force that is substantially normal to a plane in which the handle panels lies is exerted upon the centrally disposed region, the strap member is flexed substantially outwardly of the plane from a biased position proximate the plane.

Other advantages and objects of the present invention will be apparent from the following description, the accompanying drawings, and the appended claims.

DETAILED DESCRIPTION OF THE PREFERRED EMBODIMENTS

Figure 1:
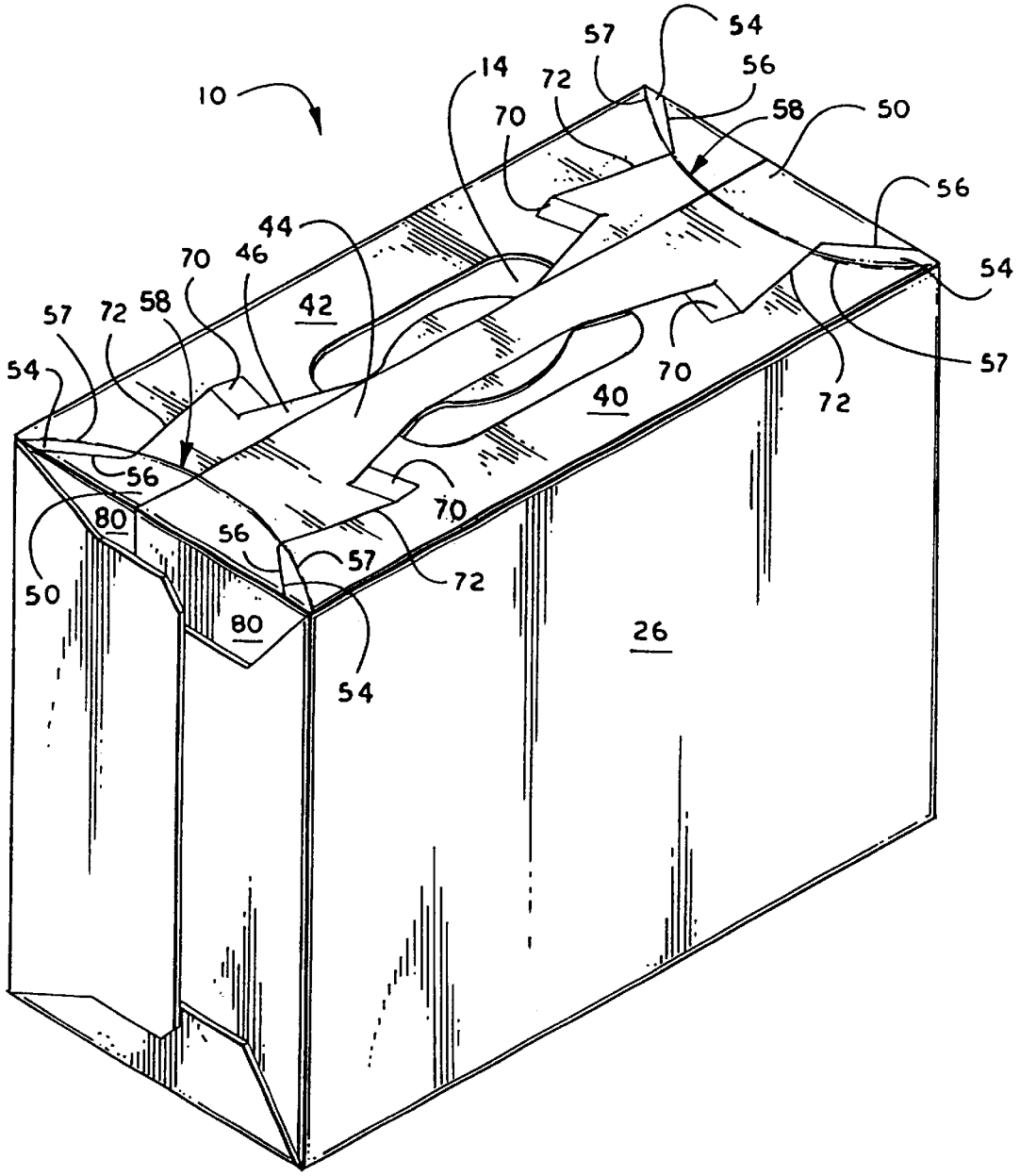
FIG. 1 is an isometric illustration of a carton having a handle structure in accordance with a preferred embodiment of the invention.

Throughout the drawings, the same reference numerals are used to denote the same or like features of the invention.

Figure 2:
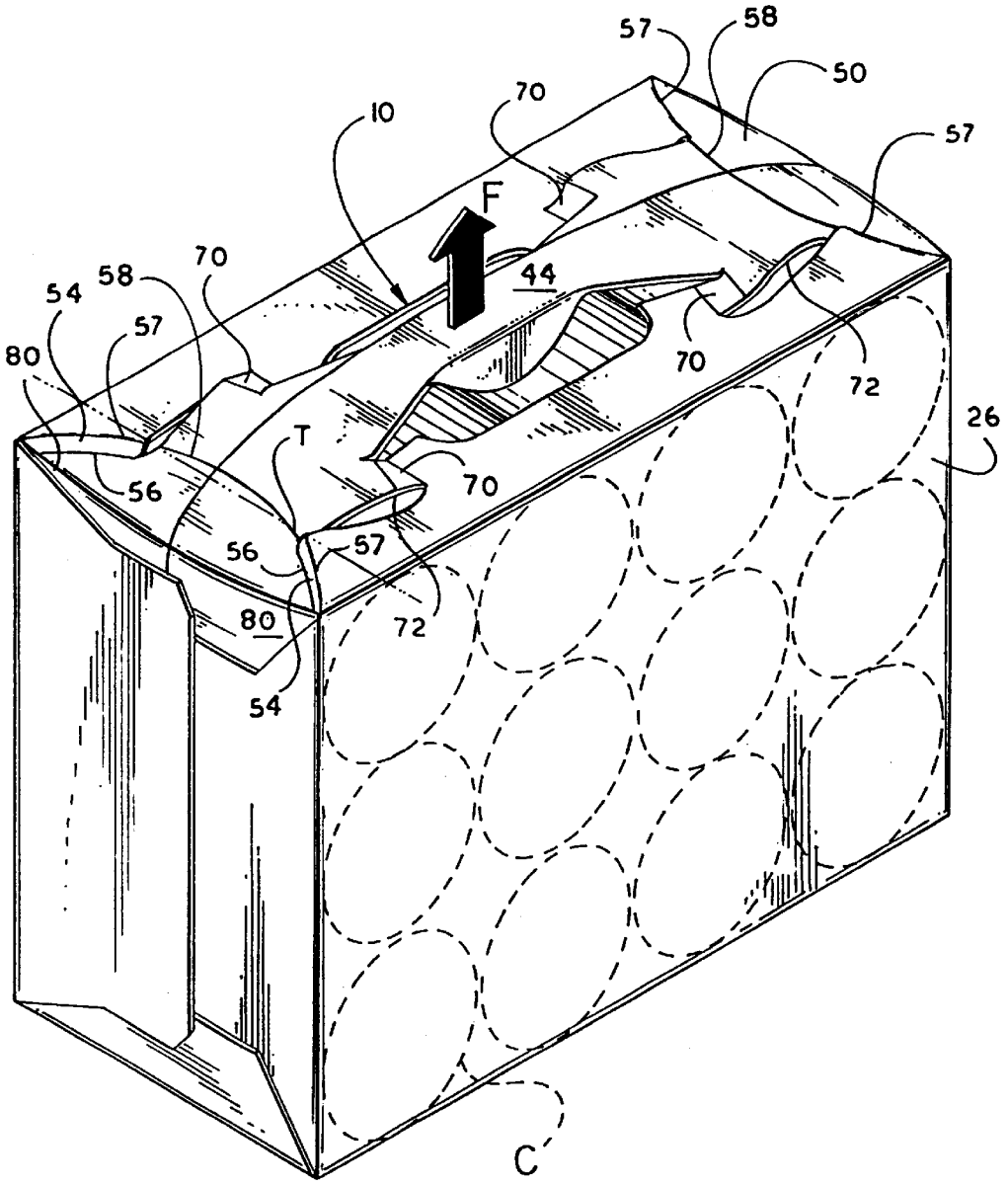
FIG. 2 is an isometric illustration of the carton of FIG. 1 with the handle member lifted upwardly.
Figure 3:
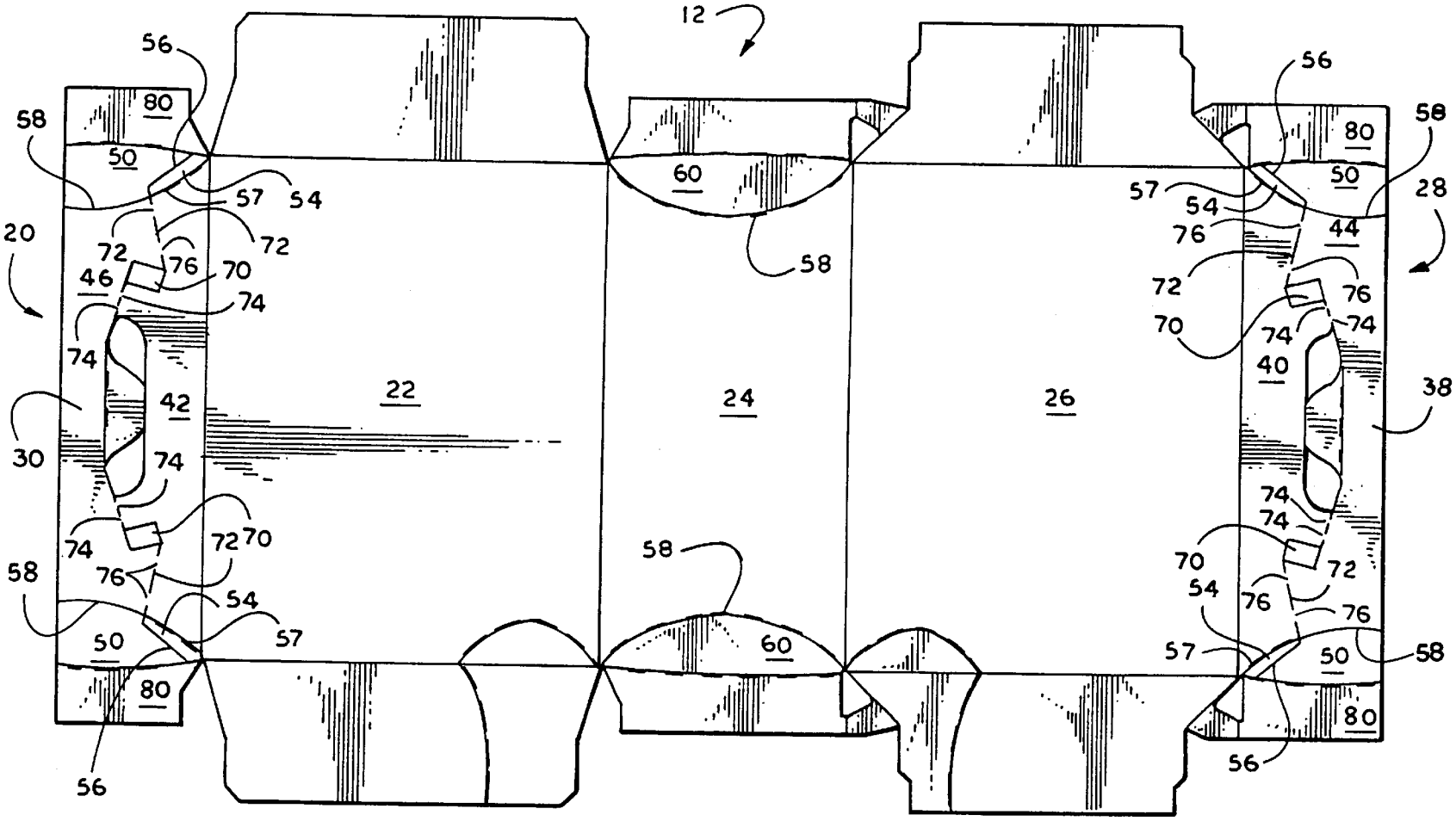
FIG. 3 is a plan view of a blank for forming the carton with the handle structure shown in FIG. 1.

For convenience of understanding, reference may be made to FIGS. 1, 2 and 3 simultaneously. FIGS. 1 and 2 illustrate a carton 10 having a handle structure in accordance with a preferred embodiment of the invention. FIG. 3 illustrates the blank 12 from which the carton of FIGS. 1 and 2 is formed.

FIG. 2 illustrates the transverse alignment of cans C with respect to the carton's 10 handle structure in accordance with a preferred embodiment of the invention. FIG. 2 also depicts the manner in which the top wall of the carton 10 including its handle structure bows upwardly when a force F is applied to lift the strap member 14.

The environment of the handle structure of the invention is a carton 10 that forms an enclosure from a series of interconnected panels. In FIG. 3, the main adjoining panels 20, 22, 24, 26 and 28 which form a tubular structure when the end-most panels 20, 28 are joined are most clearly seen.

The end-most panels 20, 28 of the blank 12 form the top wall, or panel, of the carton 12 that contains the handle structure. For convenience of explanation, each portion of the top panel 20, 28 is further described in segments. Each half-panel has a strap member 46, 44 with a tapered region 30, 38 mediate the end regions. The remaining portion 40, 42 of the top panel lies along a side edge of the top panel. Flaps 80 adjoin the end edges of the top panel. Each flap forms at least a portion of an end wall in the erected carton.

In the erected carton 10, the strap members 46, 44 overlap, to a certain extent, and the tapered regions 30, 38 overlap fully to produce a substantially reinforced handle. At the end regions of the strap handle members 46, 44 a web extends diagonally from the vertex of a side edge and an end edge of the panel.

The elongated webs 54 are defined by a spaced-apart pairing of a perforated line 57 extending diagonally from the aforementioned vertex and a score line 56 lying between the perforated line and the end edge of the panel 20, 28. The intersection of the score line 56 and perforated line 57 enhances the effectiveness of the invention.

A connecting member 70 conjoins the strap member 46, 44 and a portion of the region 42, 40 of the top panel adjacent the strap member 46, 44. Stress upon the end region of the handle structure is more evenly directed toward the ends of the handle structure and carton through the coincidence of an edge 72 (appearing as a cut line in the blank 12) of the strap member 46, 44 with the score line 56 of the elongated web. Further enhancement of the operation of the handle structure is achieved by termination of the edge 72 at the connecting tab 70.

Optionally, the end regions of the top panel, which coincide with the end regions of the handle structure, may have an intermediate web panel 50 defined by a curved, or arcuate, score line 58, which, in the blank 12, coincides with the perforated lines 57 of the elongated webs of the handle structure. Another pair of intermediate web panels 60 may also be formed at the opposing side of the carton.

The strap member 44, 46 provides a handle that directs stress toward the ends of the carton. The features of the handle structure which are described above cause the strap member 30, 38 and other elements upon the top panel of the carton to flex, or bow, in an outwardly-projecting predetermined manner when the carton 10 is lifted F. The structure of the elongated webs 54 cause the top panel 20, 28 to concavely bow in a stepped configuration, ascending inwardly, when the carton is lifted by a force, as illustrated in FIG. 2. The tapered strap member 30, 38 provides a convenient, reliable handle. The connecting tabs 70 interconnect the strap member 46, 44 and adjacent top panel regions 42, 40. This interconnection causes the top panel 20, 28 to maintain a more contiguous configuration when the carton is lifted. The side regions 42, 40 of the top panel have a tendency to flex away from the strap member. The connecting tabs inhibit such movement and promote a more pleasing appearance and greater integrity of the top panel of the carton.

The intermediate web panels 50, 60 enable the corners of the carton 10 to be drawn tighter when cans C or similar articles are transversely aligned in the carton with respect to the lengthwise dimension of the carton and top panel, as shown in FIG. 2.

The structure of the invention provides a handle that is reinforced and that directs stress away from the handle itself to the ends of the carton while helping the carton to maintain an aesthetically pleasing appearance and greater integrity when lifted.

Figure 4:
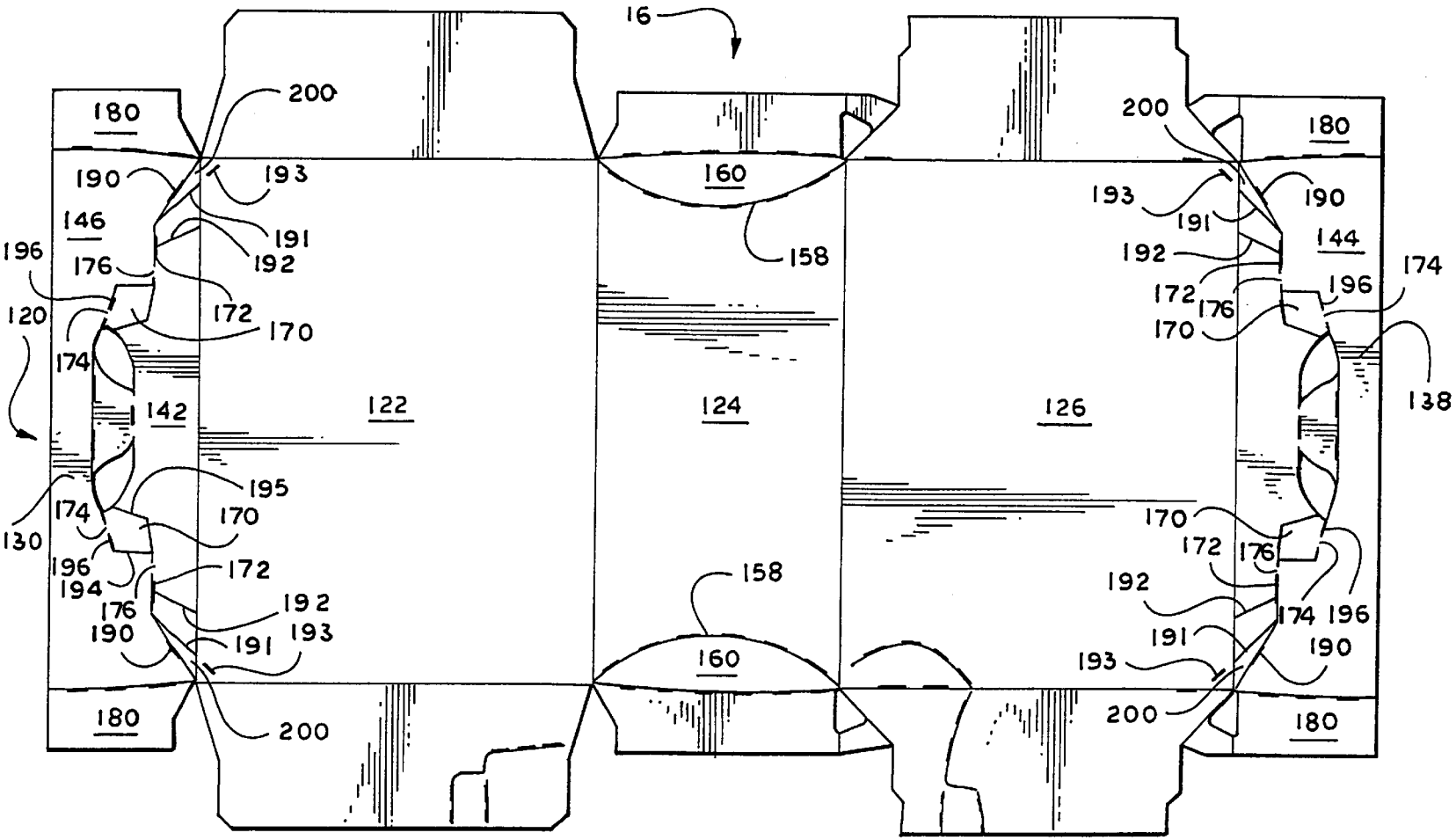
FIG. 4 is a view of a blank for forming a carton having a handle structure in accordance with an alternate preferred embodiment of the invention.
Figure 5:
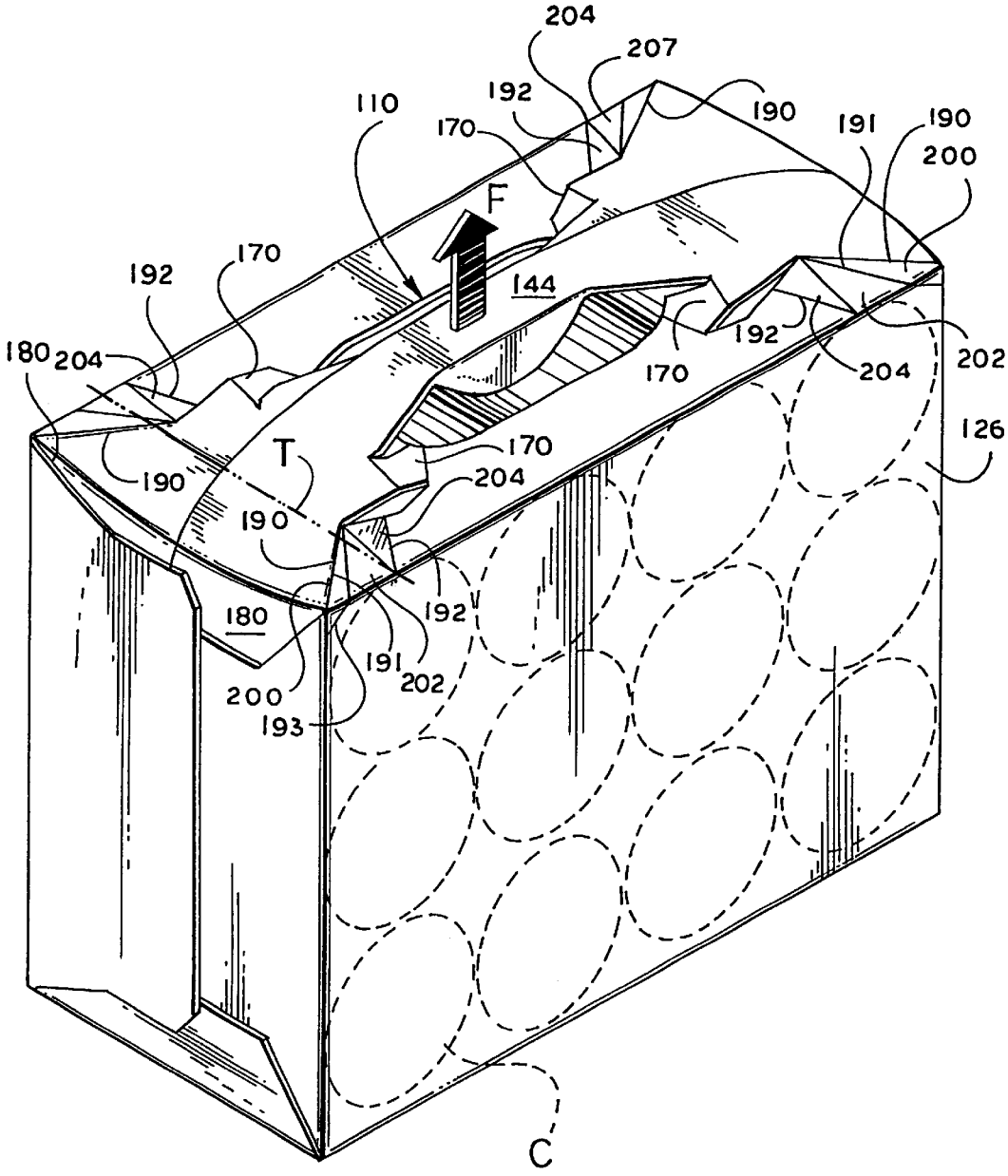
FIG. 5 is an isometric illustration of a carton having a handle structure in accordance with an alternate preferred embodiment of the invention formed from the blank of FIG. 4.

Referring now simultaneously to FIG. 4 and FIG. 5, therein is shown a carton having an alternate preferred embodiment of handle structure in accordance with the teachings of the invention. In FIGS. 4 and 5, features corresponding to like features of the preferred embodiment of the invention discussed above and illustrated in FIGS. 1–3 hare denoted by the same reference numerals but in a "100" series. For example, panel 24 in the first embodiment is denoted as 124 in the alternate preferred embodiment.

In the alternate embodiment of FIGS. 4 and 5, a first corner web 200 is formed in each corner of the top wall in which the handle structure is formed by a perforated line 191 ("perforated" in that it consists of alternating cut segments and scored segments) and a first corner score line 191 convergingly extending from the corner of the top wall or panel toward the end edge of the strap member 144. The various "webs" in this alternate embodiment are also for convenience of explanation sometimes hereinafter alternately referred to as "gussets" and "pleats." The perforated line 190 intersects the proximate vertex of the top wall where a side edge and an end edge of the top wall intersect. The first corner score line 191 is disposed intermediate the perforated line 190 and the side edge of the top wall. A second corner score line 192 is disposed adjacent the first corner score line forming another web or gusset. A diagonal cut line 193 is disposed at each corner of the side wall 122, 126 adjacent the top wall in coincident alignment with the first corner score line 191.

The cut line 172 that defines each edge of the ends of the strap member may have many orientations but in the preferred alternate embodiment illustrated is optimally disposed in substantially parallel longitudinal alignment with the strap member and the side edges of the top wall.

Tabs 170 that serve as handle gussets (webs/pleats) are formed by tab score lines 194, 195. Although the tab score lines may have many different alignments with respect to one another, in the preferred alternate embodiment illustrated they are nonparallel. One of the tab score lines 195 is directed toward the handhole aperture. Each tab 170 is further defined by the cut lines 172 and 196 that define the edges of the strap member.

Referring now particularly to FIG. 5, the particular arrangement of elements of the handle structure of the alternate preferred embodiment described above and illustrated in FIG. 5 causes the top wall of the carton to deform in a controlled manner and direct stress in a predetermined manner. Referring momentarily particularly to FIG. 4, each cut line 172, 196 that separates the strap member structure from the remainder of the top wall and tabs 170, respectively, is interrupted by a nick member that provides joinder between these elements. As the strap member is lifted F, the nick members cause the strap member 144 and tabs 170 to become separated from one another and from the top wall in a predetermined manner such that the strap member is bowed outwardly and gussets 200, 202 and 204 become angularly displaced with respect to one another. Optimally, the first gusset 200 is displaced into condition inwardly of the outwardly-bowed strap member. The lifting force exerted upon the carton causes deformation which produces joinder between the diagonal cut lines and the first score lines. This deformation in turn causes the first gusset 200 to extend over the edge of the side wall of the carton. The arrangement of elements described directs stress to the corners of the carton. Further, when articles such as cans C are aligned in the carton, the enclosed cans at the corners of the carton adjacent the first gussets acts as a "beam" or bracing element.

In one optimum mode, as the strap member is lifted, the set of nicks connecting the strap member 144 and the tabs 170 before the set of nicks connecting the strap member proximate the tabs 170 and the remainder of the top wall.

The primary elements of the handle structure of the subject invention are the strap member 30/38 & 130/138, disjoined from the handle panel 44/46 & 144/146, and what are referred to in this portion of the description as severance line segments 72 & 172. Each severance line segment extends between one point that is close to a corner of the handle panel and a second point that is close to the centrally disposed region of the strap member. This arrangement produces a spring like relationship between the strap member and the handle panel such that when a force F is exerted upon a centrally disposed region of the strap handle in a direction substantially perpendicular to a plane (or notional plane) in which the handle panel lies, the strap member flexes outwardly of the plane from a biased position proximate the plane, as illustrated in FIGS. 2 and 5. The arrangement of elements just described essentially creates a web inclusive of the pleat 70 & 170 which conjoins end regions of the strap member with the remainder of the handle panel. Stress due to the weight of the carton (and the offsetting force F use to lift and suspend the carton) is focused from the ends of the strap member toward the corners and end walls and adjacent side wall regions of the carton instead at undesirable regions of the handle panel and centrally disposed region of the strap member that are likely to tear and fail. The substantial separation of the centrally disposed region of the strap member from the plane of the handle panel helps facilitate dissipation of stress in the manner described above.

The severance line segments can be disposed in several optimal arrangements such as parallel to the side edges of the handle panel and diverging from the side panels as the severance line segment extends toward the end edges of the handle panel. In a carton in which cylindrical articles such as cans C are packaged, the end poit of the severance line segment that is closest the corner optimally terminates at or near a tangent line T where the end can of the array of packaged cans is tangent to the handle panel.

Frangible members, or nick members, 74, 76 & 174, 176 are optimally disposed bridging the web that includes the pleats 70 & 170 and the strap member and bridging severance line segments 72 & 172, respectivley, such that as a force that is substantially perpendicular to a notional plane of the handle panel is exerted upon the centrally disposed region of the strap member, the strap member flexes outwardly of the handle panel in a coordinated sequence beginning closest the centrally disposed region and progressing toward respective ones of the opposing edges.

The gussets 54 & 200 previously described above serve the same function as previously described. The gussets extend between the end point closest the corner to the corner itself. The gussets can be formed from a pair of score lines, a pair of perforated lines or a combination of a non-coincident pair of a score line and a perforated line. Modifications may be made in the foregoing without departing from the scope and spirit of the claimed invention.

What is claimed is:

1. A handle structure for a carton having a handle panel with opposing side edges and opposing end edges that intersect to form corners of the handle panel, the handle structure comprising:

a strap member integrally conjoined with the handle panel extending between said end edges having opposing strap edges substantially disjoined from the handle panel said strap member including a substantially centrally disposed region wherein opposing central strap edge segments of said opposing strap edges are substantially parallel to and mediate said opposing side edges; and a severance line segment disposed proximate each of the corners of the handle panel extending from a first end point proximate an associated one of said corners to a second end point proximate said centrally disposed region of said strap member;

such that when a force that is substantially normal to a plane in which said handle panels lies is exerted upon said centrally disposed region, said strap member is flexed substantially outwardly of said plane from a biased position proximate said plane.

2. The handle structure of claim 1, wherein each said severance line segment is substantially parallel to said opposing side edges.

3. The handle structure of claim 1, wherein each said severance line segment diverges from a proximate one of said opposing side edges as said severance line segment extends from said second end point to said first end point.

4. The handle structure of claim 1, wherein an array of cylindrical articles of a predetermined diameter are to be packaged within said carton and said first end point lies on or adjacent a tangent line where a cylindrical sidewall of a body one of the articles disposed at a corner of the array adjacent the handle panel is tangent to the handle panel.

5. The handle structure of claim 1, wherein a web conjoining an end region of said handle structure that is adjacent a termination of a respective one of said opposing strap edge and regions of the handle panel adjacent a respective one of said opposing side edges is defined in part by a respective said severance line segment.

6. The handle structure of claim 1, further comprising a gusset formed from a non-coincident pair of a score line and a perforated line disposed at each of said corners having a first end adjacent the respective said corner and a second end adjacent said first end point of said severance line segment.

7. A handle structure for blank for forming a carton having a handle panel with opposing side edges and opposing end edges that intersect to form corners of the handle panel, the handle structure comprising:

a strap member integrally conjoined with the handle panel extending between said end edges having opposing strap edges substantially disjoined from the handle panel said strap member including a substantially centrally disposed region wherein opposing central strap edge segments of said opposing strap edges are substantially parallel to and mediate said opposing side edges; and a severance line segment disposed proximate each of the corners of the handle panel extending from a first end point proximate an associated one of said corners to a second end point proximate said centrally disposed region of said strap member;

such that when a force that is substantially normal to a plane in which said handle panels lies is exerted upon said centrally disposed region, said strap member is flexed substantially outwardly of said plane from a biased position proximate said plane.

8. The handle structure of claim 7, further comprising a plurality of first frangible members interconnecting said opposing strap edges and adjacent portions of the handle panel disposed such that as a force that is substantially perpendicular to a notional plane of the handle panel is exerted upon said centrally disposed region of said strap member, said strap member flexes outwardly of the handle panel in a coordinated sequence beginning closest said centrally disposed region and progressing toward respective ones of said opposing edges.

9. The handle panel of claim 7, further comprising a plurality of second frangible members bridging said severance line segments disposed such that as a force that is substantially perpendicular to a notional plane of the handle panel is exerted upon said centrally disposed region of said strap member, said strap member flexes outwardly of the handle panel in a coordinated sequence beginning closest said centrally disposed region and progressing toward respective ones of said opposing edges.

10. The handle structure of claim 7, wherein each said severance line segment is substantially parallel to said opposing side edges.

11. The handle structure of claim 7, wherein each said severance line segment diverges from a proximate one of said opposing side edges as said severance line segment extends from said second end point to said first end point.

12. The handle structure of claim 7, wherein an array of cylindrical articles of a predetermined diameter are to be packaged within said carton and said first end point lies on or adjacent a tangent line where a cylindrical sidewall of a body one of the articles disposed at a corner of the array adjacent the handle panel is tangent to the handle panel.

13. The handle structure of claim 7, wherein a web conjoining an end region of said handle structure that is adjacent a termination of a respective one of said opposing strap edge and regions of the handle panel adjacent a respective one of said opposing side edges is is defined in part by a respective said severance line segment.

14. The handle structure of claim 7, further comprising a gusset formed from a non-coincident pair of a score line and a perforated line disposed at each of said corners having a first end adjacent the respective said corner and a second end adjacent said first end point of said severance line segment.

15. A handle structure for a carton having a handle panel with opposing side edges and opposing end edges that intersect to form corners of the handle panel, the handle structure comprising:

a strap member integrally conjoined with the handle panel extending between said end edges having opposing strap edges substantially disjoined from the handle panel said strap member including a substantially centrally disposed region wherein opposing central strap edge segments of said opposing strap edges are substantially parallel to and mediate said opposing side edges; and a severance line segment disposed proximate each of the corners of the handle panel extending from a first end point proximate an associated one of said corners to a second end point proximate said centrally disposed region of said strap member wherein a web conjoining an end region of said handle structure that is adjacent a termination of a respective one of said opposing strap edge and regions of the handle panel adjacent a respective one of said opposing side edges is is defined in part by a respective said severance line segment;

such that when a force that is substantially normal to a plane in which said handle panels lies is exerted upon said centrally disposed region, said strap member is flexed substantially outwardly of said plane from a biased position proximate said plane.

16. The handle structure of claim 15, wherein each said severance line segment is substantially parallel to said opposing side edges.

17. The handle structure of claim 15, wherein each said severance line segment diverges from a proximate one of said opposing side edges as said severance line segment extends from said second end point to said first end point.

18. The handle structure of claim 15, wherein an array of cylindrical articles of a predetermined diameter are to be packaged within said carton and said first end point lies on or adjacent a tangent line where a cylindrical sidewall of a body one of the articles disposed at a corner of the array adjacent the handle panel is tangent to the handle panel.

19. The handle structure of claim 15, further comprising a gusset formed from a non-coincident pair of a score line and a perforated line disposed at each of said corners having a first end adjacent the respective said corner and a second end adjacent said first end point of said severance line segment.

* * * * *